United States Patent [19]

Baxter et al.

[11] 4,087,355

[45] May 2, 1978

[54] SOLVENT EXTRACTION OF AROMATIC HYDROCARBONS

[75] Inventors: Clyde Edward Baxter, Angleton; Arthur Emilio Gurgiolo, Lake Jackson, both of Tex.

[73] Assignee: The Dow Chemical Company, Midland, Mich.

[21] Appl. No.: 722,934

[22] Filed: Sep. 13, 1976

[51] Int. Cl.[2] ..... C10G 21/20

[52] U.S. Cl. ..... 208/330; 260/465.8 R; 260/615 R; 260/615 B; 260/674 SE

[58] Field of Search ..... 208/330; 260/674 SE

[56] References Cited

U.S. PATENT DOCUMENTS

| | | | |
|---|---|---|---|
| 2,441,827 | 5/1948 | McKinnis | 208/330 |
| 2,765,356 | 10/1956 | Skinner | 208/330 |

FOREIGN PATENT DOCUMENTS

| | | | |
|---|---|---|---|
| 994,900 | 6/1965 | United Kingdom. | |
| 366,179 | 1/1973 | U.S.S.R. | 208/330 |

*Primary Examiner*—Herbert Levine

*Attorney, Agent, or Firm*—Benjamin G. Colley

[57] ABSTRACT

A process for the separation of aromatic hydrocarbon compounds from mixtures thereof with non-aromatic hydrocarbon compounds wherein the mixtures are contacted with a cyanoethylated alkoxylated solvent to form an extract containing the aromatics and separating the extract from the non-aromatic compounds. The modified alkoxylated solvent has the formula $$TZ—CH_2—[C(R_1R_2)]_a[CH_2]_b CH_2—ZT$$

wherein T is cyanoethyl or hydrogen; Z is the divalent group represented by $—(CH_2)_y O—(C_nH_{2n}—O)_x$ wherein $n$ is a whole number from 2–4; $x$ is a number having an average value from 3–40; $y$ is 0 or 1; $a$ is 1–4; $b$ is 0–3; $R_1$ is hydrogen, $—CH_3$, $—C_2H_5$ or —ZT; $R_2$ is hydrogen or —ZT; wherein at least one of $R_1$ or $R_2$ is —ZT and at least one T group is cyanoethyl. Examples of such solvents are the mono, di and tri cyanoethylated ethylene oxide adducts of glycerine, trimethylol propane and 1,2,6-hexane triol.

7 Claims, 4 Drawing Figures

SOLVENT EXTRACTION OF AROMATIC HYDROCARBONS

BACKGROUND OF THE INVENTION

This invention relates to a solvent extraction process for separating aromatic hydrocarbons from hydrocarbon mixtures which consist of aromatic hydrocarbons admixed with other hydrocarbons species such as paraffins, branched paraffins, cycloparaffins and/or olefins using cyanoethylated alkoxylated polyol solvents.

It is known that both extraction and distillation techniques have been employed in separating particular hydrocarbon species, e.g., the aromatic hydrocarbons, from petroleum hydrocarbon mixtures having narrow boiling point ranges. For such mixtures, solvent extraction techniques have been employed. These techniques have problems, one of the more significant being the difficulty in choosing a solvent capacity for the aromatic hydrocarbon species to be separated as compared with those hydrocarbon species not desired. Most selective solvents particularly those which are selective for aromatic materials will also dissolve significant proportions of non-aromatic hydrocarbon species.

It is desired to treat the petroleum fractions in such a manner as to separate an aromatic rich stream from the saturated and olefinic aliphatic hydrocarbons. The aromatics have very high octane numbers and are useful for blending into motor gasoline. In addition, such aromatics as benzene, toluene, and the xylenes are valuable feedstocks for a wide variety of uses in chemical industry. The raffinates can be used as components in jet fuel or heating oils or as feed to catalytic reforming. Thus, over the years, there has been a continuing search for solvents which are selective to aromatic hydrocarbons only and have a high solvent capacity for said aromatic hydrocarbons and, at the same time, dissolve very little, if any, of the non-aromatic hydrocarbon species.

A number of selective solvents have been proposed and described for the extraction of aromatic hydrocarbons from mixtures of aromatic and non-aromatic paraffins, olefinic and naphthenic hydrocarbons. For example, U.S. Pat. Nos. 2,568,159 and 2,568,176 disclose the use of cyanoethylated ethylene glycol and diethylene glycol for this purpose. The use of nitrile solvents is also mentioned in U.S. Pat. Nos. 2,458,067; 2,842,484; 3,372,109 and 3,436,437. The use of 1,2,3-tris(2-cyanoethoxy)propane as a selective solvent is disclosed in U.S. Pat. No. 3,860,512.

The solvents of this invention are more heat stable than the cyanoethylated diols and triols of the prior art.

The use of sulfolane is disclosed as a selective extractant to improve the selectivity of separation in U.S. Pat. No. 2,407,820. There are, however, several drawbacks associated with the use of sulfolane as a selective solvent in hydrocarbon extraction processes. For example, in conventional solvent extraction processes, an extract phase containing the more readily soluble component is recovered by treating the starting mixture with the selective solvent and using a liquid-liquid extraction process. The solvent is thereafter recovered from the extract as the bottoms in a distillation operation. Sulfolane, however, readily degrades at its atmospheric boiling point. Therefore, it has been found necessary to use sub-atmospheric pressure in the separation of sulfolane from the remainder of the extract phase. Furthermore, sulfolane has a relatively high freezing point 82° F, this necessitating steam heating of the lines and equipment carrying the pure solvent in order to prevent its solidification. The necessity of using elevated temperatures when handling the pure solvent and the sub-atmospheric pressure required for the separation of the dissolved components from the sulfolane results in increased capital equipment costs and higher energy requirements.

SUMMARY OF THE INVENTION

It has been discovered that aromatic hydrocarbons can be extracted selectively from mixtures of aromatic, olefinic and aliphatic hydrocarbons using mono, di and tri cyanoethers and alkoxylated polyols. The invention comprises a process for the separation of aromatic hydrocarbon compounds from mixtures containing both aromatic and non-aromatic compounds which comprises (A) contacting a mixture containing both aromatic and non-aromatic hydrocarbon compounds with a cyanoethylated alkoxylated polyol solvent having at least three alkoxylated hydroxyl groups to form an extract containing said solvent and the aromatics wherein said solvent has the formula $$TZ{-}CH_2{-}\left[C(R_1)(R_2)\right]_a\left[CH_2\right]_b{-}CH_2{-}ZT$$

wherein T is cyanoethyl or hydrogen Z is the divalent group represented by $-(CH_2)_y\,O-(C_nH_{2n}-O)_x$ wherein $n$ is a whole number from 2–4, $x$ is a number having an average value from 3–40 and $x$ has an average value equal to or less than 3 when $n$ is 3 or 4, $y$ is 0 or 1, $a$ is 1–4, $b$ is 0–3, $R_1$ is hydrogen, $-CH_3$, $-C_2H_5$, or $-ZT$, $R_2$ is hydrogen or $-ZT$, with the proviso that at least one of $R_1$ or $R_2$ is $-ZT$ and at least one T group is cyanoethyl, and (B) separating said extract from the non-aromatic compounds.

Preferred modified solvents for use in this invention have the formula $$TZCH_2 - CH_2(ZT) - CH_2ZT$$

wherein T is cyanoethyl or hydrogen, Z is the divalent group represented by $-O-(C_nH_{2n}-O)_x$, $n$ is a whole number from 2–4, $x$ is a number having an average value from 3–40 and $x$ has an average value equal to or less than 3 when $n$ is 3 or 4 with the proviso that at least one T group is cyanoethyl.

These heat stable solvents are generally prepared by making alkoxylated adducts of polyols and then end capping the adducts with acrylonitrile as is known from British Patent Specification No. 994,900 and Canadian Pat. No. 720,510. Ethylene oxide, propylene oxide, butylene oxide or mixtures thereof can be used as the alkoxylating agents. The polyols used as starting materials can be selected from glycerine, trimethlolpropane, 1,2,3-butane triol, diglycerol, pentaerythritol, erythritol, 1,2,4-butane triol, 1,2,6-hexane triol, mannitol and the like.

DETAILED DESCRIPTION

Figure 1:
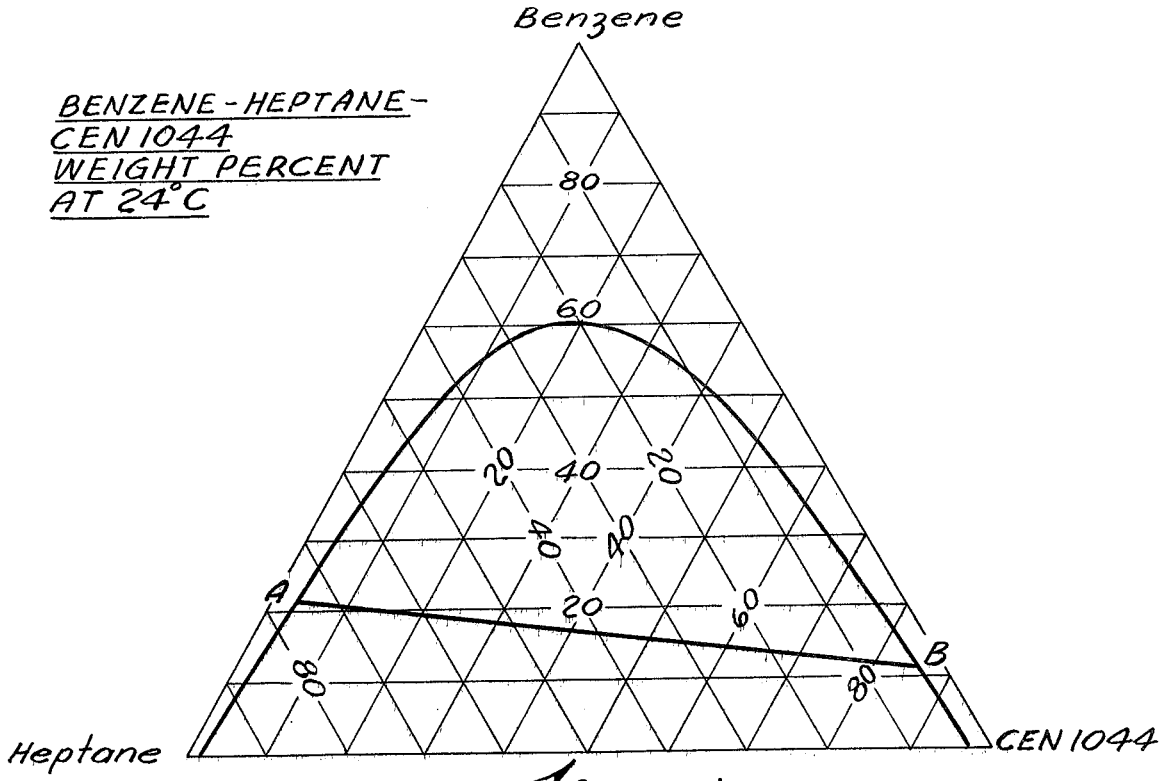

Suitable feedstocks for the satisfactory practice of this invention include fluid mixtures having a sufficiently high concentration of aromatic hydrocarbons to economically justify their recovery as a separate product stream. The present invention is particularly applicable to hydrocarbon feed mixtures which contain at least about 25 percent by weight of aromatic hydrocarbons. A suitable carbon number range for the feedstock is from about six carbon atoms per molecule to about 20 carbon atoms per molecule and, preferably, from about six to 10 carbon atoms per molecule. Typically, the feedstock will contain single ring hydrocarbons comprising a wide boiling mixture of benzene, toluene and xylenes. These aromatic hydrocarbons are mixed with corresponding paraffins and olefins.

The aromatic hydrocarbons are separated from the mixed hydrocarbon stream by contacting the stream in a conventional liquid-liquid extraction technique, with the end group modified polyol solvents set forth above.

The extraction of aromatic hydrocarbons from a mixed hydrocarbon stream using these solvents may take place at temperatures from about 70° to about 250° F, preferably at temperatures ranging from about 120° to 180° F. The pressure is not critical and it is, therefore, convenient to use atmospheric pressure. Typically, from 1 to 5 volumes, preferably about 2 to 3 volumes, of solvent are employed per volume of feedstock.

The invention may be more fully understood and illustrated by FIGS. 1–4 of the drawing which are ternary immiscibility diagrams for a representative solvent of this invention. The use of these diagrams is essential for the adequate presentation of liquid-liquid equilibrium data. These diagrams are well known from Alders "Liquid-Liquid Extraction", Elservier Publ. Co., New York (1959) and Treybal "Liquid Extraction", McGraw-Hill, New York (1951).

FIG. 1 shows the ternary solubility diagram for preparation 12 herein (CEN 1044), benzene, and heptane at 24° C wherein the closed type phase diagram indicates complete miscibility of the benzene with the solvent. The area outside of the curve represents the one phase region, so, for effective extraction to occur the solvent to feed ratio would have to be regulated so that the composition of solvent, benzene, and heptane would be under the curve. For example, suppose a 50:50 mixture of benzene and heptane was to be extracted with CEN 1044 at 24° C. The minimum solvent/feed composition to effect extraction would be 47.5% benzene, 47.5% heptane, 5% solvent. However, a solvent composition of 75–80% is usually employed to obtain more complete extraction. The further the solvent composition point lies to the right under the curve (higher percent solvent) the more complete the extraction. However, it is economically unfeasible to use too high a solvent composition.

Figure 2:
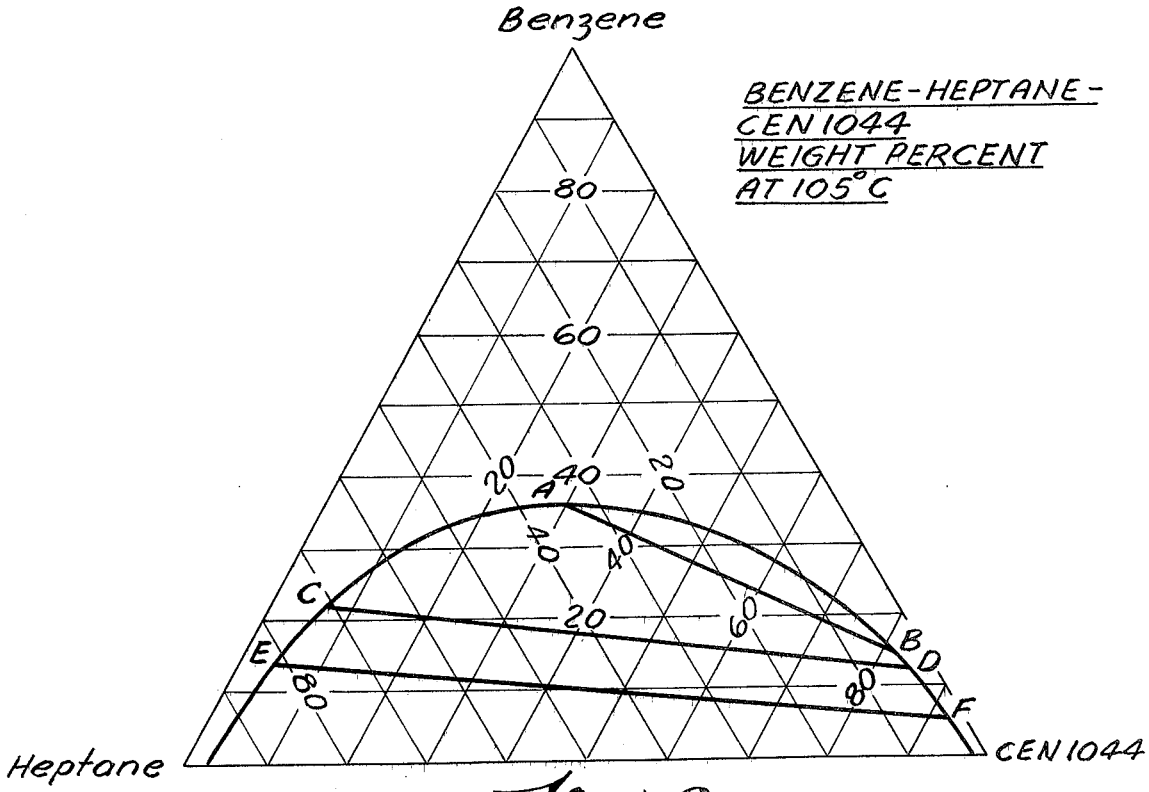

FIG. 2 shows the ternary solubility diagram for the same system as FIG. 1 at 105° C which also shows a closed type phase diagram. It can be seen that increasing the extraction temperature increases the mutual solubility of heptane and solvent for aromatics. In other words, the solvent is in effect competing with the heptane for solubility of the benzene. Increasing the temperature of extraction increases the solubility of the benzene. Increasing the temperature of extraction increases the solubility of benzene in solvent (increases capacity) but also increases the solubility of heptane (decreases selectivity). This is evidenced by a decrease in the two phase region (area under curve). Extraction of a 50:50 benzene/heptane feedstock at 105° C with CEN 1044 would require a minimum solvent composition of 34% benzene, 36% heptane, 30% solvent.

Figure 3:
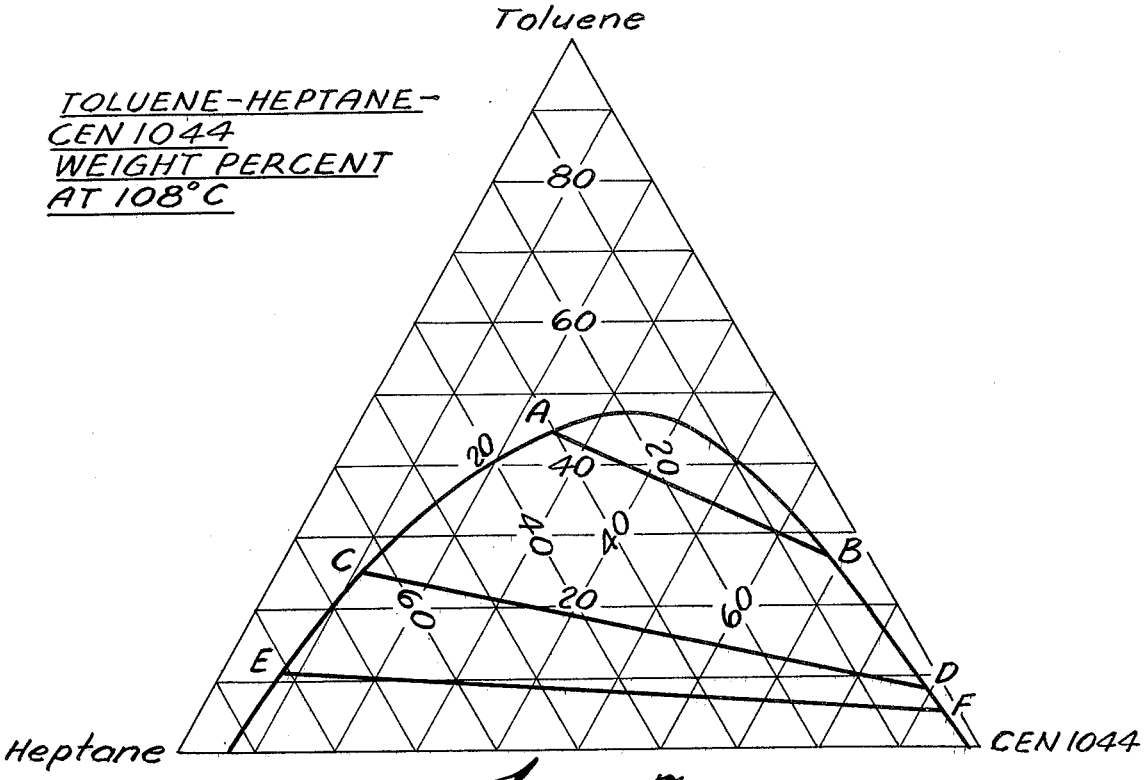

FIG. 3 shows a solubility diagram for preparation 12 herein (CEN 1044), toluene, and heptane and again shows a closed type phase diagram. Increasing the molecular weight of the aromatic by the introduction of aliphatic side chains, i.e., methyl groups serves to decrease the solubility of solvent for these aromatics (decreases capacity). The two phase region (area under the curve) is increased. Extraction of a 50:50 toluene/heptane feedstock at 108° C with CEN 1044 would require a minimum of solvent composition of 40% benzene, 40% heptane, 20% solvent.

Figure 4:
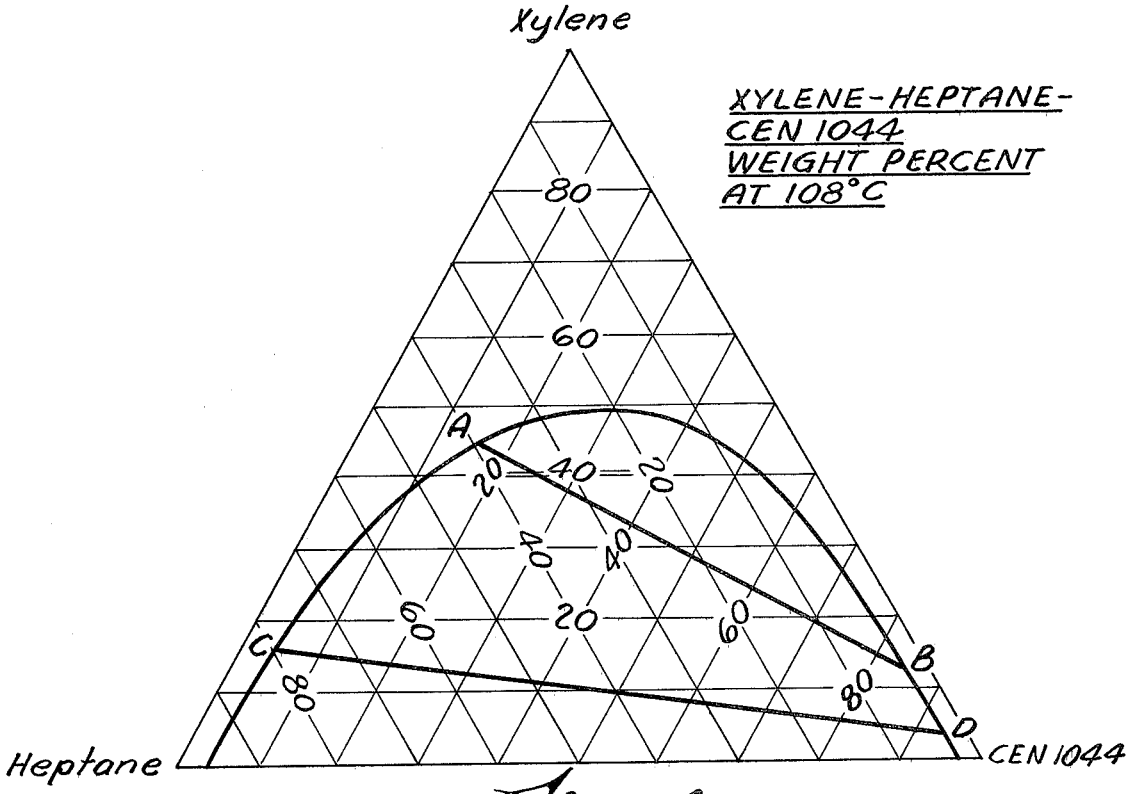

FIG. 4 shows a ternary solubility diagram for preparation 12 herein (CEN 1044), xylene, and heptane at 108° C similar to FIG. 3. Again, increasing the aromatic molecular weight by introduction of aliphatic side chains, decreases the solubility of solvent for aromatics (decreases capacity).

Extraction of a 50:50 xylenes/heptane feedstock would require a minimum solvent composition of 44% benzene, 42% heptane, 14% solvent.

The CEN 1044 solvent shows an exceptional curve for extraction of xylene, an important property commercially.

The recovery of aromatics from a mixture with aliphatic hydrocarbons, using the solvents of this invention is advantageous over conventional systems in that the boiling point of the solvent is dramatically higher than any component of the feed stock. Consequently, the solvent plus aromatic extract can be heated quite hot in a still and the aromatics distilled from the solvent. This permits recovery of higher boiling aromatics such as ethylbenzene and poly substituted benzenes. When these components are present, it may also be advantageous to inject a low amount of aliphatic hydrocarbon such as pentane to help sweep the higher boiling aromatics out of the system. The pentane, being low boiling, may then easily be recovered by distillation and recycled.

Alternately, the solvent-aromatic extract may be treated with pentane, and the aromatics extracted into the pentane layer. This layer is decanted from the solvent and distilled to recover the low boiling pentane for recycle and the aromatics fractionated as usual. The solvent is then recycled.

If much olefinic hydrocarbon is present in the feedstock, it will tend to transfer to the aromatic-solvent layer. On distillation of the aromatics from this extract, the olefins tend to polymerize and build up in the solvent. Since the solvent cannot be distilled as in the conventional solvents, it must be periodically purified in other ways. One way is to run the contaminated solvent over a charcoal bed which absorbs the polyolefins. Another way is to add water to the contaminated solvent. The solvent dissolves in the water and the polyolefins will separate as an insoluble phase. Water is then distilled from the purified solvent, and the solvent recycled. If desired, for economic reasons, 5% water may be left in the solvent and recycled to the extraction column. As shown in Table III, 5% water in these new solvents will increase the selectivity and decrease the capacity to some extent.

Preparations 1–6

A series of glycerine ethylene-oxide triols were prepared by reacting varying amounts of ethylene oxide with glycerine using potassium hydroxide as the catalyst. These compounds are described in Table I.

TABLE I

GLYCERINE-ETHYLENE OXIDE TRIOLS

| Preparation | Moles EO | Weight Average Mol. Wt. (GPC) | % OH |
|---|---|---|---|
| 1 (CE 225) | 3 | 190 | 22.6 |
| 2 (CE 350) | 6 | 290 | 13.6 |
| 3 (CE 490) | 9 | 420 | 9.7 |
| 4 (CE 620) | 12 | 590 | 7.5 |
| 5 (CE 750) | 15 | 690 | 6.3 |
| 6 (CE 885) | 18 | 850 | 5.4 |

GPC - determined by gel permeation chromatography

Preparations 7–12 (tricyanoethylation of a glycerine ethylene oxide triol)

Each of the above preparations were cyanoethylated by dissolving the glycerine-ethylene oxide triols in equal weights of benzene and treating with 1.5 moles acrylonitrile per mole of hydroxyl using a KOH catalyst. Reaction times were on the order of 1–2 hours at temperatures of 45°–55° C. Low boiling components were distilled off under reduced pressure. The products prepared are listed in Table II.

TABLE II

CYANOETHYLATED GLYCERINE ETHYLENEOXIDE TRIOLS

| Preparation | Mol. Wt. (GPC) | Refractive Index | % N Found | % N Theory | Viscosity (cks) 14° F | 100° F | 210° F |
|---|---|---|---|---|---|---|---|
| 7 (CEN 384) | 380 | 1.4692 | 11.8 | 10.9 | 3,500 | 55.17 | 7.1 |
| 8 (CEN 509) | 520 | 1.4695 | 8.4 | 8.3 | 5,600 | 60.2 | 11.1 |
| 9 (CEN 649) | 620 | 1.4712 | 6.5 | 6.5 | 4,900 | 102.0 | 14.1 |
| 10 (CEN 779) | 780 | 1.4716 | 5.4 | 5.4 | — | — | — |
| 11 (CEN 909) | 890 | 1.4722 | 4.6 | 4.6 | 8,600 | 120.8 | 17.0 |
| 12 (CEN 1044) | 1025 | 1.4730 | 4.0 | 4.0 | 12,600 | 142.2 | 19.8 |

EXAMPLES 1–6

Aromatic capacity and selectivity values were determined for each solvent of preparations 7–12 by extracting stock solutions of 50% benzene/50% heptane and 50% xylenes/50% heptane with the solvents in a 3:1 solvent/feed ratio for 1 hour at ambient temperature. The layers were allowed to separate for 1–3 hours and the extract layer was then analyzed by gas chromatography (gc) for percent benzene and percent heptane extracted. A Hewlitt Packard 5700A Gas Chromatography with Hewlitt Packard 3373B Integrator was used for this purpose. Analysis was carried out on a 3 foot × ⅛ inch stainless steel thin wall column packed with Porapac Q, 100–120 mesh. The gas chromatogram was run isothermally at 170° C for benzene analysis and 200° C for xylenes analysis with an injection port temperature of 200° C and a detector temperature of 250° C. The solvents do not elute. The results are shown in Table III.

Antisolvent effects of water were determined for some of the solvents by adding 5% water to the solvent and extracting as above. Addition of water is a common practice used commercially to enhance solvent selectivity. This is also shown in Table III.

Ternary solubility data were determined by either of the following two methods:

(1) Cloud point method: heptane was added to varying mixtures of benzene/solvent. The point of first turbidity was recorded.

(2) Extraction method: stock solutions ranging from 25% aromatic/75% heptane to 85% aromatic/15% heptane were extracted in a 3:1 solvent/feed ratio at 105° C. A 3 dram stainless steel vial was charged with solvent and feed and heated with a Temp Blok ® Module Heater. The vial was shaken by hand intermittently over a period of 1 hour, allowing 1–3 hour equilibration time before sampling. A sample of the extract layer was then withdrawn by syringe through a septum on top of the vial. The sample was analyzed by gas chromatography for percent aromatic and percent heptane extracted.

TABLE III

AROMATIC EXTRACTION DATA AT 24° C

| Examples | Solvent | % $H_2O$ | Benzenes - Capacity | Benzenes - Select. | Xylenes Capacity | Xylenes Selectivity |
|---|---|---|---|---|---|---|
| 1 | Prep. 7 | 0 | .81 | 36.3 | .37 | 8.6 |
| 2 | Prep. 8 | 0 | .93 | 32.3 | .34 | 6.1 |
| | | 5 | .88 | 39.3 | | |
| 3 | Prep. 9 | 0 | 1.13 | 30.9 | .38 | 5.3 |
| | | 5 | .93 | 40.6 | | |
| 4 | Prep. 10 | 0 | 1.16 | 29.4 | .42 | 5.4 |
| 5 | Prep. 11 | 0 | 1.31 | 28.6 | .50 | 5.7 |
| 6 | Prep. 12 | 0 | 1.36 | 28.4 | .65 | 6.7 |
| Control 1 | Sulfolane | 0 | 1.06 | 45.3 | .59 | 17.0 |
| | | 5 | 0.98 | 66.0 | .39 | 18.4 |
| Control 2 | Tetraethylene Glycol | 0 | 0.32 | 16.3 | .13 | 11.3 |
| | | 5 | 0.21 | 21.9 | .08 | 11.1 |
| Control 3 | Triethylene Glycol | 0 | 0.30 | 16.3 | .11 | 7.6 |
| | | 5 | 0.21 | 16.7 | — | — |
| Control 4 | Diethylene Glycol | 0 | 0.33 | 16.4 | .09 | 7.8 |
| | | 5 | 0.26 | 22.1 | — | — |
| Control 5 | N-Methyl Pyrrolidone | 0 | 1.2 | 9.0 | — | — |
| Control 6 | 1,2,3-tris cyanoethoxy propane | 0 | 0.36 | 46.75 | .12 | 12.20 |
| Control 7 | Cyanoethylated ethylene glycol | 0 | 0.48 | 28.50 | — | — |
| Control 8 | Cyanoethylated tetraethylene glycol | 0 | 0.52 | 15.9 | — | — |

Capacity is defined as a distribution coefficient which is the ratio of the concentration of aromatics in the solvent phase to the concentration of aromatics in the raffinate phase.

Selectivity is defined as the ratio of the distribution coefficient for aromatics divided by the distribution coefficient for nonaromatics.

Capacity increases as the solvent dissolves more aromatics, and selectivity increases as the ability of the solvent to reject aliphatics increases.

The above data indicate that the solvents of Examples 1–6 have a superior capacity to the controls in most instances. Capacity is by far the most important parameter in comparison with selectivity since the former determines the amount of circulating solvent required for extraction and subsequently the size of physical plant.

EXAMPLE 7

In the same manner as described for preparations 1–6, one mole of trimethylol propane was reacted with 18 moles of ethylene oxide to make a triol having a weight average molecular weight of 926.

This product was then cyanoethylated with 1.5 moles of acrylonitrile per mole of hydroxyl group by the process set forth in preparations 7–12 to make a product having a weight average molecular weight of 1085.

Under the extraction conditions set forth in Table III, this compound was found to have a capacity for benzene of 0.93 and a selectivity for benzene of 19.8.

EXAMPLE 8

Following the procedures of Example 7, one mole of 1,2,6-hexane triol was ethoxylated with 18 moles of ethylene oxide to obtain a product having a weight average molecular weight of 926.

This was then cyanoethylated with 1.5 moles of acrylonitrile per hydroxy group to give a product having a weight average molecular weight of 1085. This was found to have a capacity for benzene of 0.89 and a selectivity for benzene of 11.4.

EXAMPLE 9

A 500 ml, 3 neck reactor was equipped with stirrer, thermometer, condenser and separatory funnel.

In the reactor was put 300 g. (0.34 moles) of a glycerine-ethylene oxide triol of mol. wt., 885 (glycerine + 18 mole of ethylene oxide). This product (CE 885) had about 0.1% KOH catalyst left in it from its preparation (preparation 6).

In the funnel was put 18 g. (0.34 moles) of acrylonitrile (0.333 moles acrylonitrile per mole of hydroxyl). This was fed to the CE 885 over a 30 minutes period. Exotherm carried the temperature to 40° C. The reaction product was digested 1.5 hours. Now the catalyst was neutralized with concentrated HCl, and volatiles removed at 60° C for 5 hours at 100 mm pressure.

There was recovered 316 g. (89% yield) of a yellow colored polyol which is the monocyanoethyl glycerine-ethylene oxide adduct. Refractive Index = 1.4730.

This product was found to have a capacity for benzene of 0.93 and a selectivity for benzene of 28.9.

We claim:

1. A process for the separation of aromatic hydrocarbon compounds from mixtures containing both aromatic and non-aromatic compounds which comprises:

(A) contacting a mixture containing both aromatic and non-aromatic hydrocarbon compounds with an cyanoethylated alkoxylated polyol solvent having at least three alkoxylated hydroxyl groups to form an extract containing said solvent and the aromatics wherein said solvent has the formula $$TZ—CH_2\text{-}[C(R_1)(R_2)]_a[CH_2]_b\ CH_2—ZT$$

wherein T is cyanoethyl or hydrogen, Z is the divalent group represented by $\text{-}(CH_2)_y O\text{-}(C_nH_{2n}O)\text{-}_x$. $n$ is a whole number from 2–4, $x$ is a number having an average value from 3–40 and $x$ has an average value equal to or less than 3 when $n$ is 3 or 4, $y$ is 0 or 1, $a$ is 1–4, $b$ is 0–3, $R_1$ is hydrogen, $—CH_3$, $—C_2H_5$ or —ZT, $R_2$ is hydrogen or —ZT, with the proviso that at least one of $R_1$ or $R_2$ is —ZT and at least one T group is cyanoethyl, and (B) separating said extract from the non-aromatic hydrocarbon compounds.

2. The process as set forth in claim 1 wherein the cyanoethylated polyol is derived from trimethylol propane.

3. The process as set forth in claim 1 wherein the cyanoethylated polyol is derived from 1,2,6-hexane triol.

4. A process for the separation of aromatic hydrocarbon compounds from mixtures containing both aromatic and non-aromatic compounds which comprises:

(A) contacting a mixture containing both aromatic and non-aromatic hydrocarbon compounds with an cyanoethylated alkoxylated glycerine solvent to form an extract containing said solvent and the aromatics wherein said solvent has the formula $$TZCH_2 — CH_2(ZT) — CH_2ZT$$

wherein T is cyanoethyl or hydrogen, Z is the divalent group represented by $—O—(C_nH_{2n}—O)_x$ wherein $n$ is a whole number from 2–4, $x$ is a number having an average value from 3–40 and $x$ has an average value equal to or less than 3 when $n$ is 3 or 4 with the proviso that at least one T group is cyanoethyl and (B) separating said extract from the non-aromatic hydrocarbon compounds.

5. The process as set forth in claim 4 wherein the solvent has an $n$ value of 2 and $x$ value of about 6.

6. The process as set forth in claim 5 wherein the solvent is tricyanoethylated.

7. The process as set forth in claim 5 wherein the solvent is monocyanoethylated.

* * * * *